US007294027B1

(12) United States Patent
Tyler

(10) Patent No.: US 7,294,027 B1
(45) Date of Patent: Nov. 13, 2007

(54) ELECTRICAL TERMINAL WITH LAYERED SPRINGS

(75) Inventor: Adam P. Tyler, Rochester Hills, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/606,417

(22) Filed: Nov. 30, 2006

Related U.S. Application Data

(60) Provisional application No. 60/849,525, filed on Oct. 3, 2006.

(51) Int. Cl.
*H01R 13/187* (2006.01)

(52) U.S. Cl. ..... 439/845

(58) Field of Classification Search ..... 439/852, 439/851, 843, 829, 845
See application file for complete search history.

(56) References Cited

U.S. PATENT DOCUMENTS

| | | | | |
|---|---|---|---|---|
| 3,370,265 | A | 2/1968 | Berg | 339/256 |
| 3,541,494 | A | 11/1970 | Berg | 339/75 |
| 4,342,498 | A | 8/1982 | Patton et al. | 339/256 |
| 4,403,411 | A | 9/1983 | Patton | 29/879 |
| 4,540,233 | A | 9/1985 | Saijo et al. | 339/258 |
| 4,880,401 | A | 11/1989 | Shima et al. | 439/746 |
| 5,226,842 | A | 7/1993 | Endo et al. | 439/843 |
| 5,271,741 | A | 12/1993 | Saito et al. | 439/843 |
| 5,441,428 | A | 8/1995 | Hamai et al. | 439/843 |
| 6,062,918 | A * | 5/2000 | Myer et al. | 439/839 |
| 6,139,376 | A | 10/2000 | Ooya et al. | 439/843 |
| 6,171,155 | B1 | 1/2001 | Miwa et al. | 439/852 |
| 6,283,802 | B1 | 9/2001 | Sato et al. | 439/843 |
| 6,290,553 | B1 | 9/2001 | Sato et al. | 439/843 |
| 6,758,701 | B2 | 7/2004 | Kato | 439/852 |
| 6,851,989 | B2 * | 2/2005 | Maeda | 439/852 |

* cited by examiner

*Primary Examiner*—Phuong Dinh
(74) *Attorney, Agent, or Firm*—Harrington & Smith, PC

(57) ABSTRACT

Disclosed herein is an electrical terminal. The electrical terminal includes a frame, a first spring, and a second spring. The frame has a receptacle section adapted to receive a male contact. The first spring is movably captured in the receptacle section. The second spring is movably captured in the receptacle section. The second spring has a first side and a second side. The first side slidably contacts the first spring. The second side comprises a contact surface for contacting the male contact when the male contact is inserted into the receptacle section.

25 Claims, 9 Drawing Sheets

ELECTRICAL TERMINAL WITH LAYERED SPRINGS

CROSS REFERENCE TO RELATED APPLICATION

This application claims priority under 35 U.S.C. §119(e) to U.S. provisional patent application No. 60/849,525 filed Oct. 3, 2006 which is hereby incorporated by reference in its entirety.

BACKGROUND OF THE INVENTION

1. Field of the Invention

The present invention relates to an electrical connector and, more particularly, to an electrical terminal with layered springs.

2. Brief Description of Prior Developments

U.S. Pat. Nos. 6,171,155 and 6,139,376 disclose multi-piece electrical receptacle terminals. A single terminal spring is provided to mechanically and electrically connect a male contact or blade terminal from a mating electrical connector in the receptacle terminals. These types of terminals are used in various types of electrical connector housings.

A single terminal spring is limited by its geometry (physical envelope) and mechanical properties in terms of the maximum contact normal force attainable, the range of elastic deflection, and the spring rate (deflection at desired force). Additionally, these single spring configurations are likely to become overstressed and demonstrate significant stress relaxation over time when exposed to high temperatures.

Accordingly, there is a need in the art to provide a terminal spring assembly that overcomes these drawbacks.

SUMMARY OF THE INVENTION

In accordance with one aspect of the present invention, an electrical terminal is disclosed. The electrical terminal includes a frame, a first spring, and a second spring. The frame has a receptacle section adapted to receive a male contact. The first spring is movably captured in the receptacle section. The second spring is movably captured in the receptacle section. The second spring has a first side and a second side. The first side slidably contacts the first spring. The second side comprises a contact surface for contacting the male contact when the male contact is inserted into the receptacle section.

In accordance with another aspect of the present invention, an electrical terminal is disclosed. The electrical terminal includes a frame and a plurality of separate springs. The frame has a receptacle section adapted to receive a male contact. The receptacle section comprises a fixed contact surface. The plurality of separate springs is connected to the frame. The plurality of springs is disposed adjacent to one another. The springs are configured to deflect away from the fixed contact surface in response to reception of the male contact in the receptacle section.

In accordance with yet another aspect of the present invention an electrical terminal is disclosed. The electrical terminal includes a frame and a leaf spring arrangement. The frame has a receptacle section adapted to receive a male contact. The receptacle section comprises a fixed contact surface. The leaf spring arrangement includes at least two separate leaf spring elements disposed within the receptacle section. The leaf spring arrangement is oriented opposite to the fixed contact surface. The leaf spring arrangement is configured to provide a contact force on the male contact when the male contact is received between the leaf spring arrangement and the fixed contact surface.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
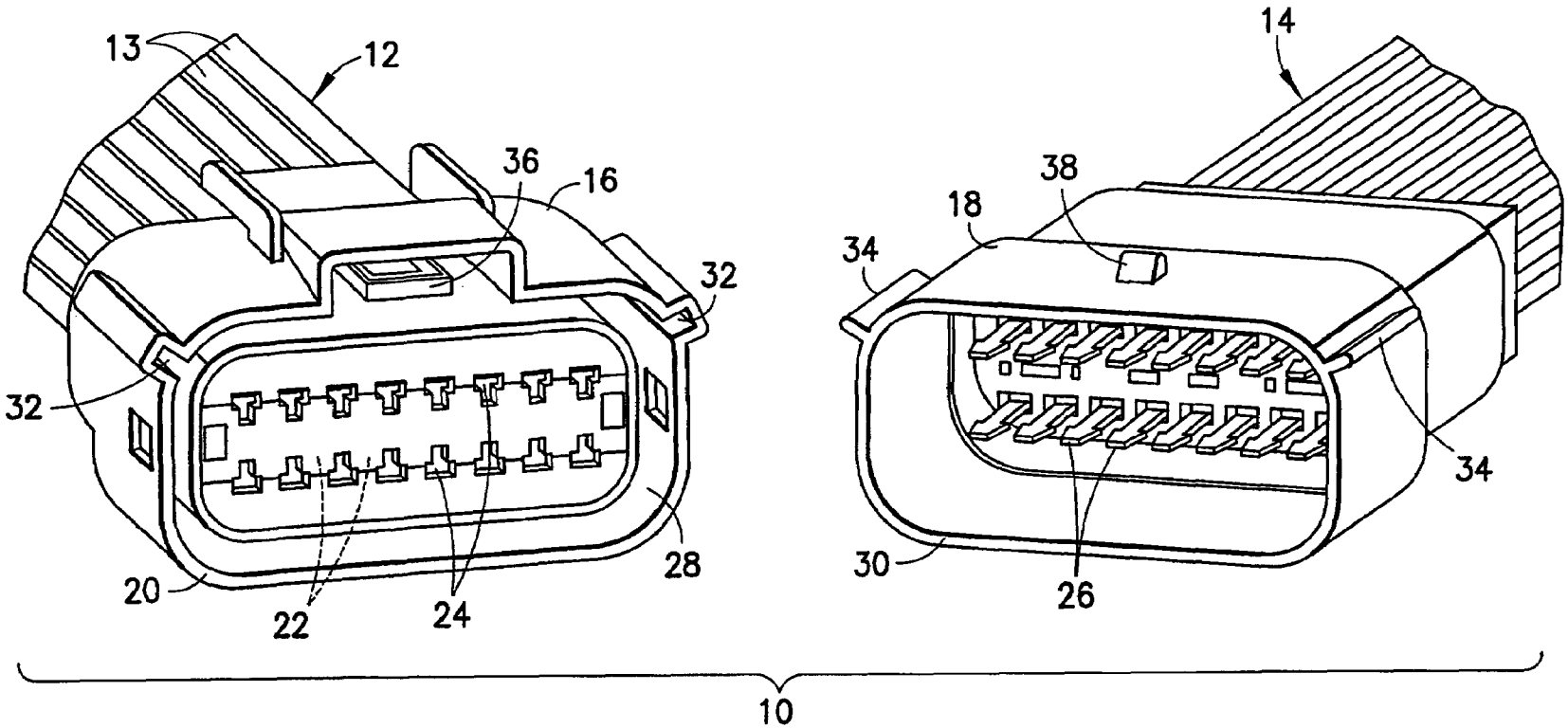
FIG. 1 is an exploded perspective view of an electrical connection system.

Referring to FIG. 1, there is shown an exploded perspective view of an electrical connection system 10 for electrically connecting two groups 12, 14 of electrical conductors to each other. The electrical connection system 10 comprises a first electrical connector 16 incorporating features of the present invention and a second electrical connector 18. Although the present invention will be described with reference to the exemplary embodiment shown in the drawings, it should be understood that the present invention can be embodied in many alternate forms of embodiments. In addition, any suitable size, shape or type of elements or materials could be used.

The first electrical connector 16 is connected to the first group 12 of electrical conductors 13. The mating second electrical connector 18 is connected to the second group 14 of electrical conductors. The first electrical connector 16 comprises a housing 20 and electrical terminals 22 located inside the housing 20. The housing 20 has receiving areas 24 in its front face for receiving male contacts 26 of the second electrical connector 18. The housing 20 also comprises a receiving area 28 for receiving a front end of a housing 30 of the second electrical connector 18. The receiving area 28 comprises slots 32 for receiving polarizing ribs 34 of the second electrical connector 18. The housing 20 also comprises a latch 36 which extends into the receiving area 28. The latch 36 is adapted to snap lock latch with a latch protrusion 38 of the housing 30 of the second electrical connector 18. Although FIG. 1 shows the housing 20 comprising the slots 32 and the latch 36, and the housing 30 comprising the ribs 34 and the latch protrusion 38, it is to be understood that these features are not required and alternate embodiments having any suitable configuration for securing the electrical connectors together are envisioned. For example, one alternative configuration does not exhibit ribs or latches at all but merely will have the front end of the housing 30 with appropriate dimensions to cause an interference fit or a press fit with the receiving area 28.

Figure 2:
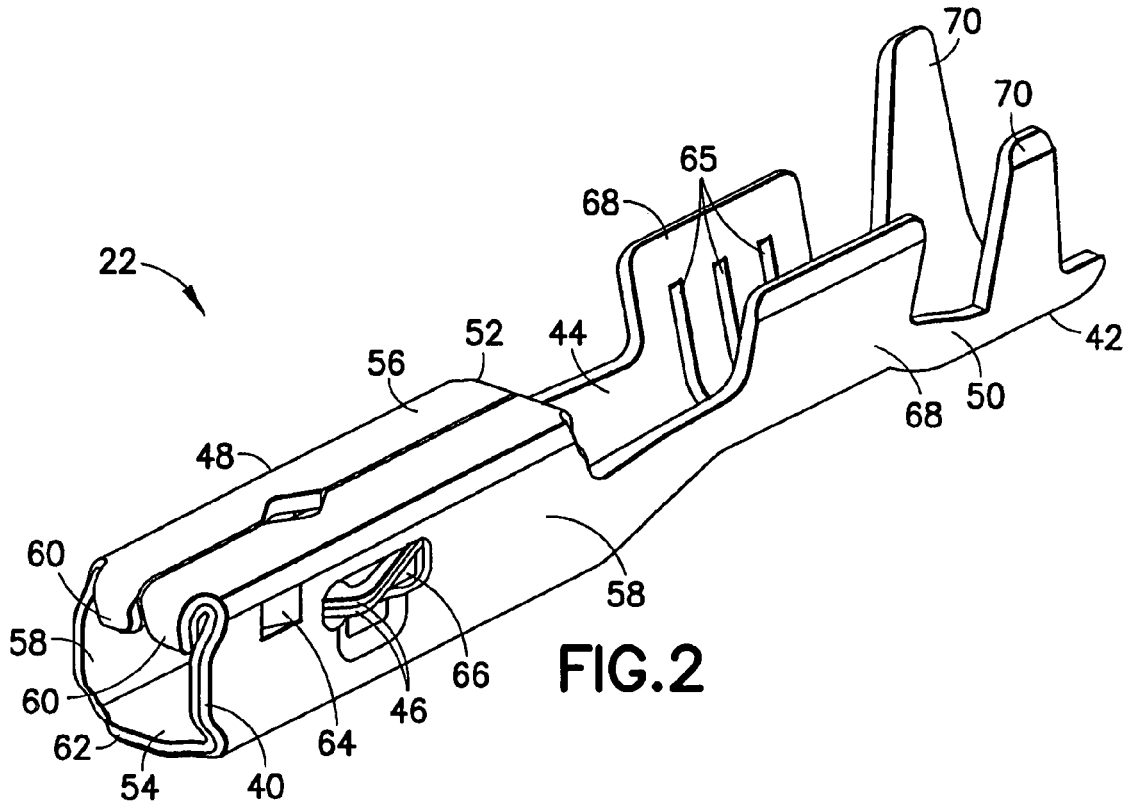
FIG. 2 is a perspective view of one of the terminals used in the connector shown in FIG. 1.
Figure 4:
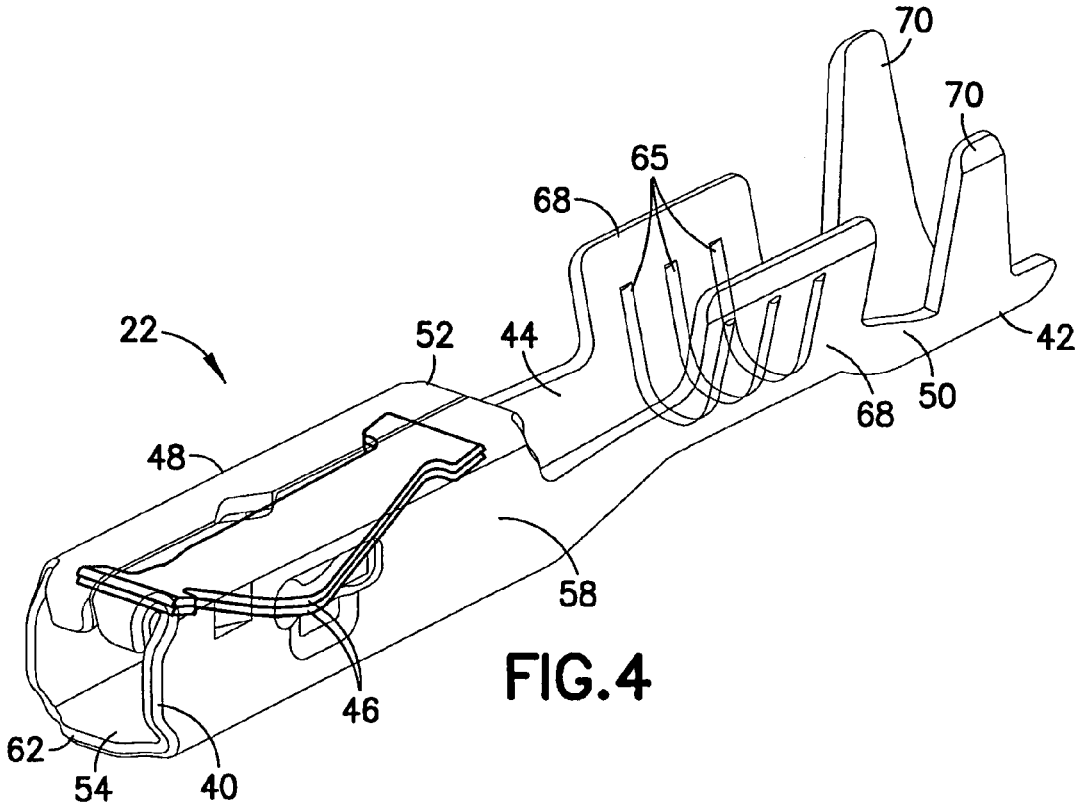
FIG. 4 is a partial cut-away perspective view of the terminal shown in FIG. 2.

FIG. 2 illustrates a perspective view of the electrical terminal 22. The electrical terminal 22 is generally configured to receive one of the male contacts 26 of the second electrical connector 18. The male contact 26 is mated to the electrical terminal 22 through a front end 40 of the electrical terminal 22. Additionally, a rear end 42 of the electrical terminal 22 is adapted to receive one of the electrical conductors 13 of group of electrical conductors 12. The electrical terminal 22 generally comprises a terminal body or frame 44 and a plurality of springs 46. The springs 46 are mounted to the frame 44. However, the electrical terminal 22 could comprise additional members.

The electrical terminal frame 44 is preferably a one piece member made from sheet metal or other conductive material. The terminal frame 44 has a front receptacle section 48 and a rear conductor connection section 50. The front receptacle section 48 is a shell adapted to admit therein the male contact 26 of the second electrical connector 18. Preferably, the receptacle section 48 has a generally rectangular tubular shape. An open seam in the receptacle section 48 extends from the front 40 of the terminal 22 to the rear 52 of the receptacle section 48. In alternate embodiments, the receptacle section 48 may have any other suitable tubular shape (such as a tube with a generally polygonal cross-section or a generally circular cross-section) to admit therein the male contact 26 and may be either seamless or have a closed seam.

The receptacle section 48 has a bottom side 54, a top side 56 and two lateral side walls 58 connecting the top side 56 to the bottom side 54. The bottom side 54 further comprises a fixed contact surface 55 (best illustrated in FIG. 7). The top 56 and bottom sides 54 span between the side walls 58 of the receptacle section 48. In the preferred embodiment, the open seam is located in the top side 56 of the receptacle section 48 substantially bisecting the top side 56 into two sections. Alternatively, the open seam may be located in any other side of the receptacle section 48. The front end of the top side 56 comprises inward cantilevered projections 60. The projections 60 help to define the male contact entrance 62 at the front of the receptacle section 48.

Figure 3:
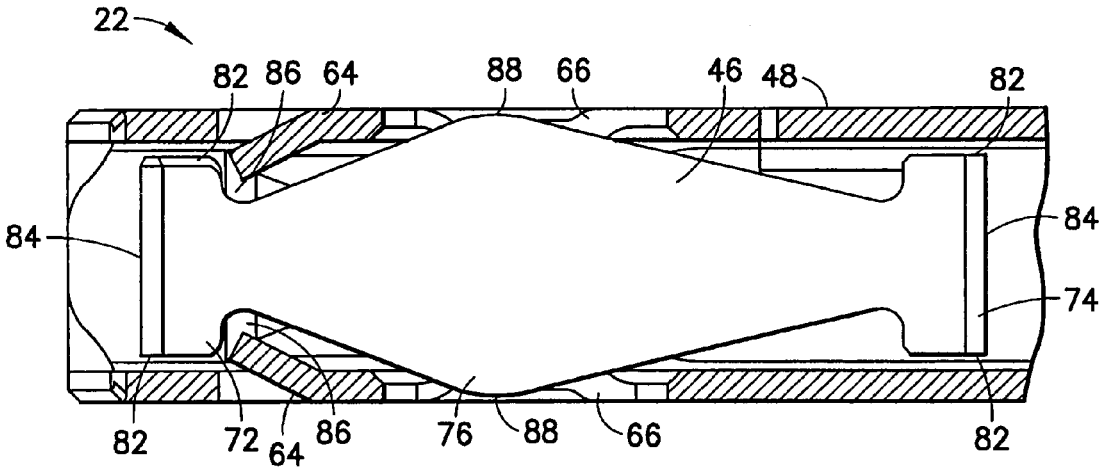
FIG. 3 is a cross sectional view of the terminal shown in FIG. 2.
Figure 5:
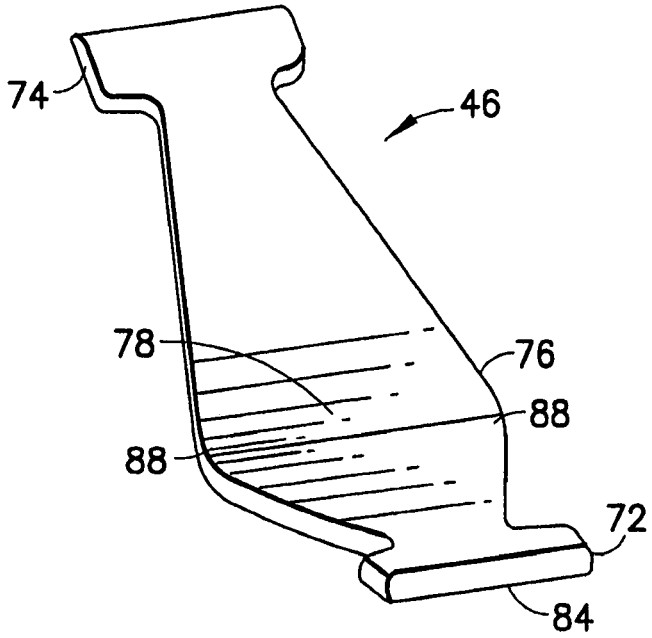
FIG. 5 is a perspective view of a spring used in the terminal shown in FIGS. 2-4.
Figure 6:
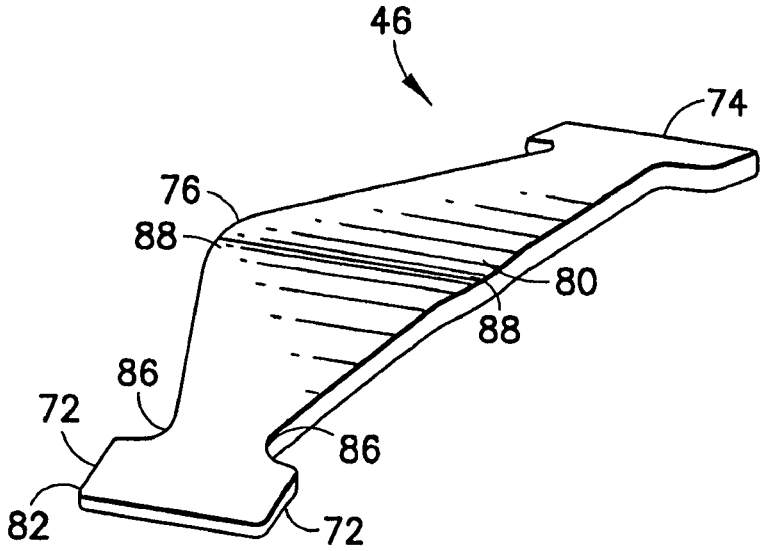
FIG. 6 is a perspective view of a spring used in the terminal shown in FIGS. 2-4.

Referring now to FIGS. 2 and 3, the lateral side walls 58 each comprise inward cantilevered projections 64 proximate the front end of the receptacle section 48, spaced slightly rearwardly from the projections 60. This forms a pocket or receiving area at the underside of the top side 56 proximate the front of the receptacle section 48 between the projections 60 and the projections 64. The lateral side walls 58 each also comprise holes 66. The holes 66 are located behind the projections 64.

The rear conductor connection section 50 of the electrical terminal 22 has a general channel configuration adapted to receive the conductor 13 therein. The conductor connection section has an inner pair 68 and an outer pair 70 of crimp tabs. The inner pair of crimp tabs 68 are set closer together than the outer pair 70. The inner pair of crimp tabs 68 are provided with depressed ridges 65 between the tabs as shown in FIG. 2. The terminal 22 is connected to the conductor by placing the conductor in the connection section 50 and crimping the inner pair 68 and outer pair 70 of crimp tabs. The inner pair 68 are crimped around the conducting core (not shown) and the outer pair 70 are crimped around the insulation (not shown) of the conductor.

Referring to FIGS. 3-6, the plurality of springs 46 disposed within the receptacle section 48 are arranged as a general leaf spring assembly. The leaf springs 46, or leaf spring elements, are substantially identical to each other and stacked against one another. However, in alternate embodiments the leaf springs 46 could be different from each other. Each of the leaf springs 46 are in sliding contact with one another as they deflect and/or bend in response to insertion of the male contacts 26 into the receptacle section 48. The disclosed leaf spring assembly provides significant advantages over conventional single spring configurations including improved durability and reduced stress.

Each of the springs 46 is preferably stamped from sheet metal or other conductive material. When viewed from the top (see FIG. 3), each of the springs 46 has a shape comprising two hammer-head or T shaped opposite ends 72, 74 and a center section 76 which tapers in width towards the two ends 72, 74 from a relatively wide middle or center section 76. The center section 76 is bent or curved to form a bent or curved leaf spring shape (i.e. a general "V" shape). The bent or curved section forms a concave shape on a first side of the springs 46 and a convex shape on a second side of the springs 46. The ends 72, 74 are substantially the same. However, in alternate embodiments the ends could be different from each other. The ends 72, 74 each generally comprise two laterally outward projections 82 and a flat end edge 84. Pockets 86 are formed behind the projections 82 at the front end 72. The middle section 76 comprises two lateral tab sections 88 at its middle.

The springs 46 are mounted to the frame 44 of the electrical terminal 22 within the receptacle section 48. The springs 46 are stacked against one another wherein the first (concave) side of one of the springs 46 is adjacent the second (convex) side of the other springs 46. As the springs 46 bend/deflect, the springs 46 slidably contact each other such that the first side of one of the springs 46 slidably contacts a majority of the second side of the other spring 46. The springs 46 are positioned and orientated within the receptacle section 48 to form a leaf spring assembly opposite the interior of the bottom side 54 of the receptacle section 48. The springs 46 are installed in the receptacle section 48 with the center sections 76 down (convex sides facing the bottom side 54) and the front and rear ends 72, 74 up (concave sides facing the top side 56). The tab sections 88 are movably located in the holes 66 of the side walls 58 of the receptacle section 48. Interaction between the tab sections 88 and the frame 44 limit downward movement of the springs 46 in the receptacle section 48. The tab sections 88 can move up and down in the holes 66 as the springs 46 are deflected by the male contact 26 when it is inserted into the receptacle section 48.

The front ends 72 of the springs 46 are located between the projections 60, 64 with the projections 64 being received in the pockets 86. The edge 84 at the front end 72 of the springs 46 closest to the top side 56 can be located directly against the interior side of the top side 56. Because the front ends 72 of the springs 46 are located between the projections 60, 64 the front ends 72 are substantially prevented from moving longitudinally along the receptacle section 48. The center sections 76 and rear ends 74, on the other hand, are able to longitudinally move along the receptacle section 48 as the edge 84 of the rear end 74 of the spring 46 closest to the top side 56 slides along the interior side of the top side 56. In alternate embodiments, any suitable mounting configuration for the springs 46 is envisioned. Furthermore, it should be noted that in alternate embodiments, one or more of the springs 46 could be integral with the frame 44.

Figure 7:
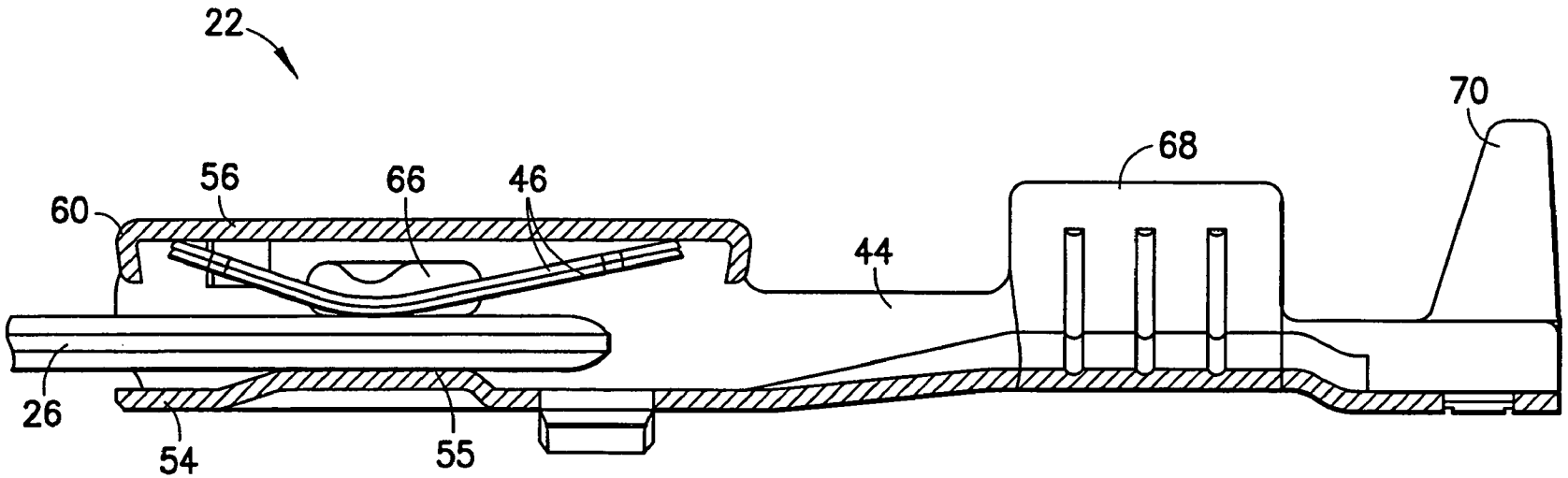
FIG. 7 is a cross sectional view of the terminal shown in FIGS. 2-4.

Referring also to FIG. 7, the springs 46 provide a contact force for mating to the male contact 26. The center of the springs 46 closest to the bottom side 54 of the receptacle section 48 acts as a contact surface for providing the contact force to the male contact 26. When the male contact 26 of the second electrical connector 18 is inserted into the receptacle section 48, between the springs 46 and the fixed contact surface 55, the front end 72 of the springs 46 are substantially prevented from moving rearward (although there might be some slight movement) because of the presence of the projections 64 behind the front end 72 (in the pockets 86). Thus, the center sections 76 and rear ends 74 are forced rearward as the middle sections 76 are deflected upward by the male contact 26.

The electrical terminal 22 with layered springs 46 uses two or more layered springs 46 that are thinner than the spring utilized in conventional single spring configurations. For a given deflection, the thinner springs 46 exhibit decreased stress when compared to the conventional single spring, but tend to provide decreased spring force. The required spring force may be achieved by using multiple springs 46. Therefore, the layered spring arrangement provides a means for reducing stress wherein the springs 46 exhibit lower stress for the same force and deflection.

Further, the electrical terminal 22 with layered springs 46 has significant advantages over conventional single spring terminals including increased overall spring flexibility and reduced stresses. Furthermore, the layered springs 46 with lower stress at their nominal deflection will exhibit less stress relaxation over time when exposed to high temperatures.

Additionally, although the figures illustrate the electrical terminal 22 as having two springs 46, it should be understood that electrical terminals 22 having three or more springs 46 are envisioned.

Figure 8:
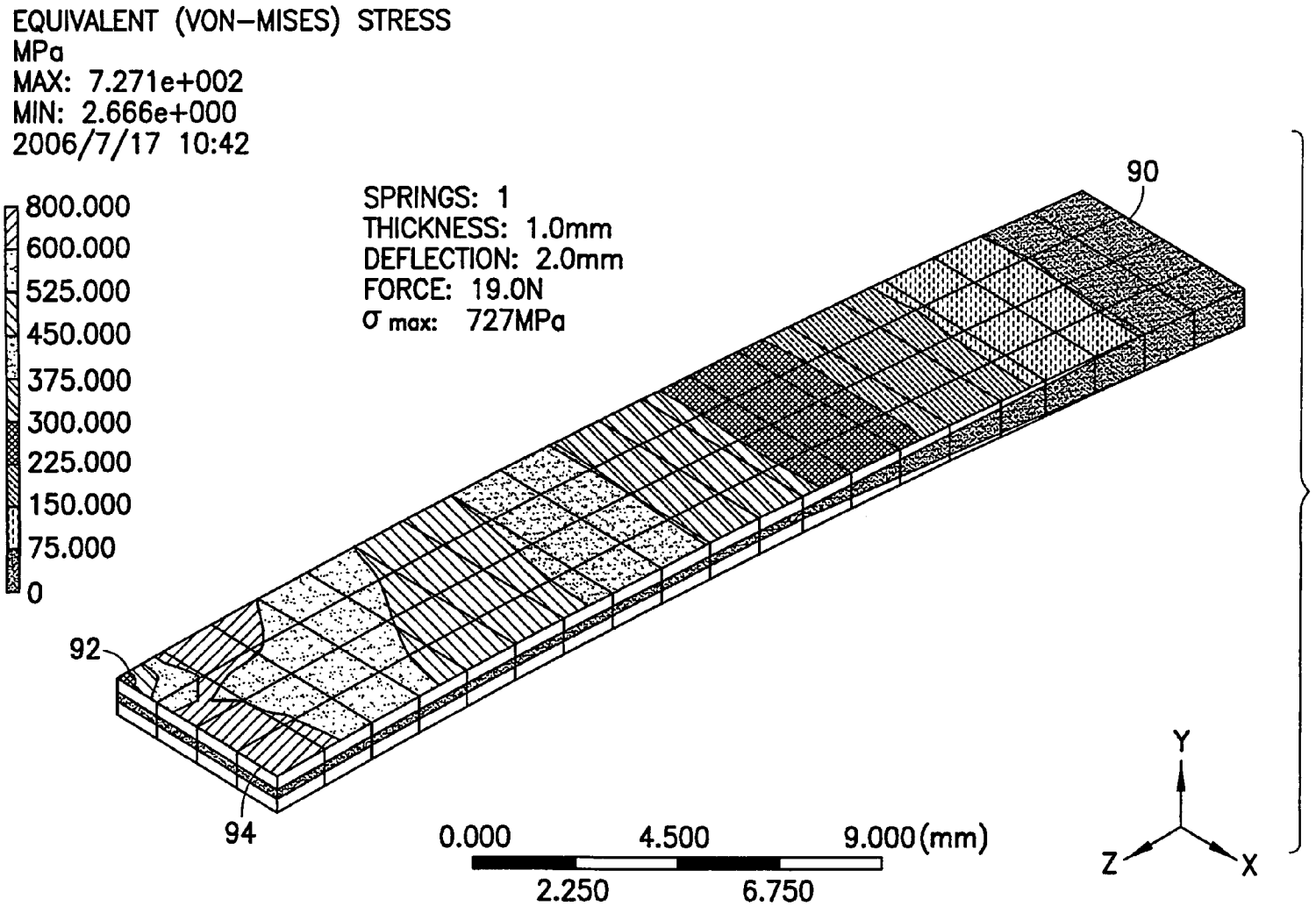
FIG. 8 is a result of a finite element analysis for a single spring terminal configuration.
Figure 9:
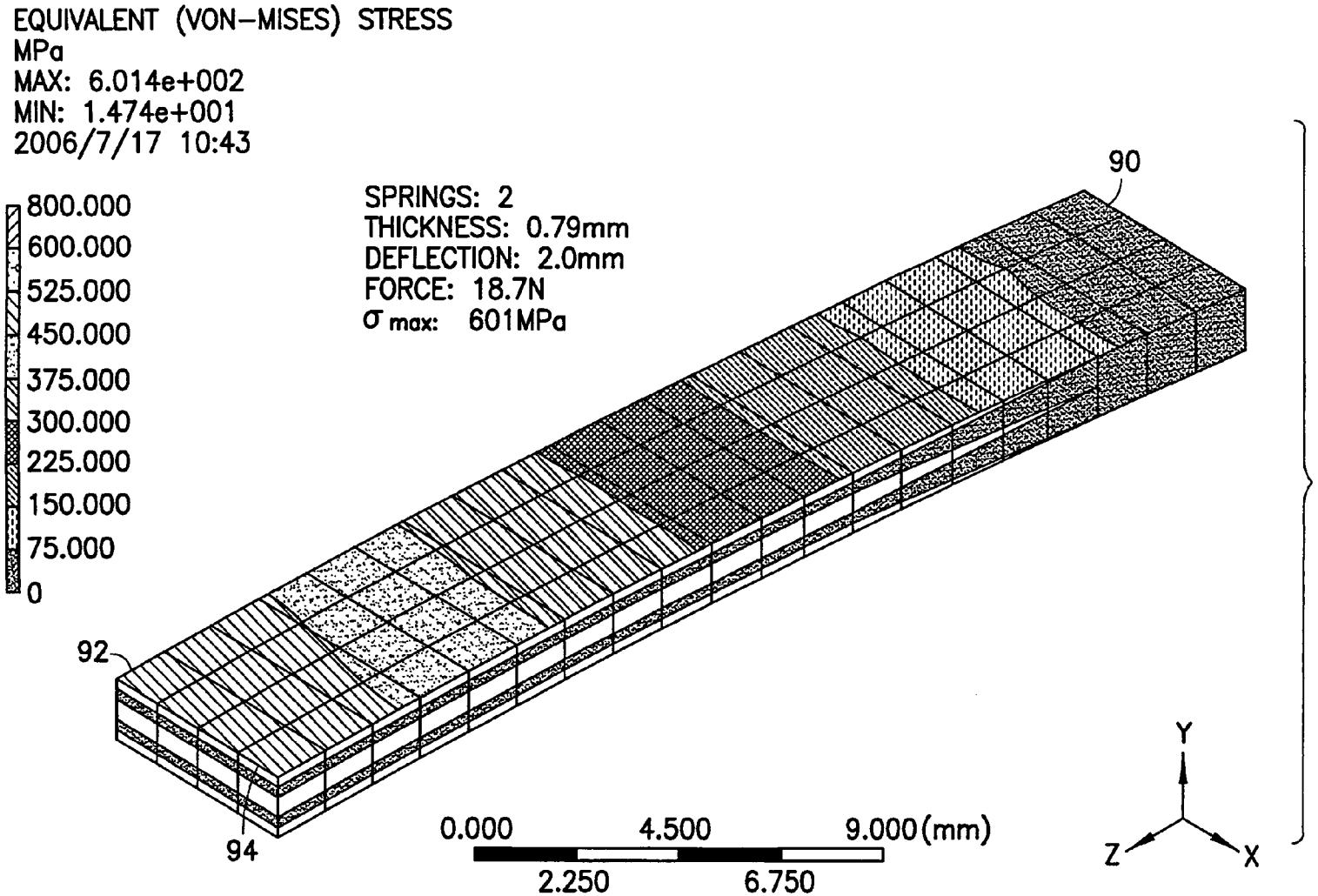
FIG. 9 is a result of a finite element analysis for a two spring terminal configuration.
Figure 10:
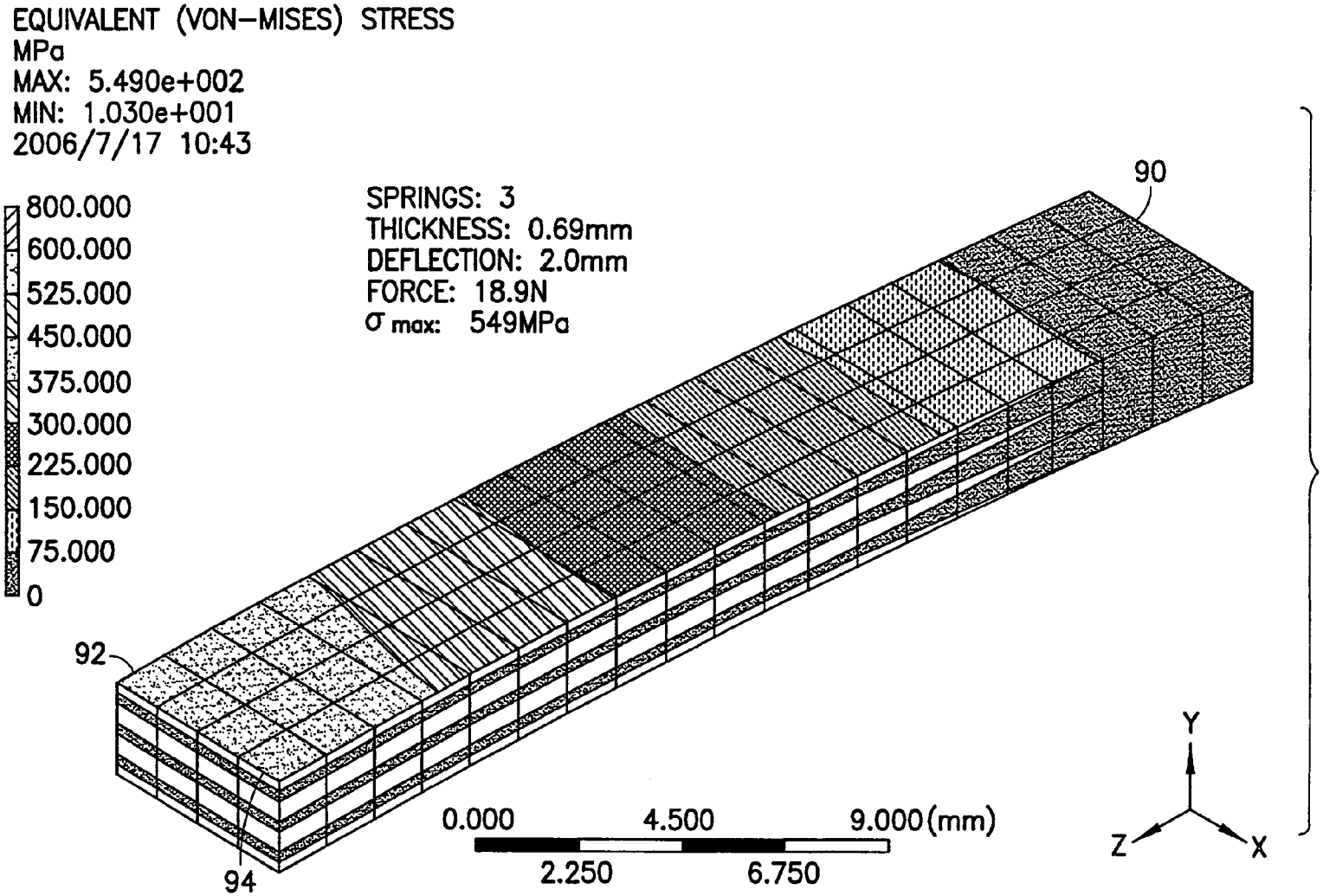
FIG. 10 is a result of a finite element analysis for a three spring terminal configuration.

FIGS. 8-10 illustrate results from a finite element analysis (FEA) modeled to represent the springs 46 in the electrical terminal 22. The FEA uses a simple cantilever showing that with carefully selected beam thicknesses (lengths and widths being equal), the force at a given deflection will remain the same with the addition of one or more spring layers while the equivalent stress is reduced. Analytically, the springs 46 within the electrical terminal 22 can be modeled as a simple cantilever under the conditions of one unconstrained end 90 and one fixed end 92.

FIG. 8 shows FEA results for a single spring under a 2.0 mm deflection applied to the otherwise unconstrained end 90. The results illustrate areas of increasing stress from the unconstrained end 90 to the fixed end 92. Under these conditions, the FEA predicts a maximum stress location 94 experiencing 727 megapascals (MPa). As can be seen in FIGS. 9 and 10, with the same amount of deflection (such as 2.0 mm for example), but increasing the number of springs 46 (two springs in FIG. 9 and three springs in FIG. 10), wherein each of the individual springs is thinner than the single spring in FIG. 8, the maximum stress locations 94 experience 601 MPa and 549 MPa, respectively. This reduction in maximum stress provides for increased durability and operational life of the electrical terminal 22.

Additionally, it should be understood that even though FIGS. 8-10 list spring thicknesses of 1.0 mm, 0.79 mm, and 0.69 mm, springs 46 of any suitable thickness for use in the electrical terminal 22 are envisioned.

Figure 11:
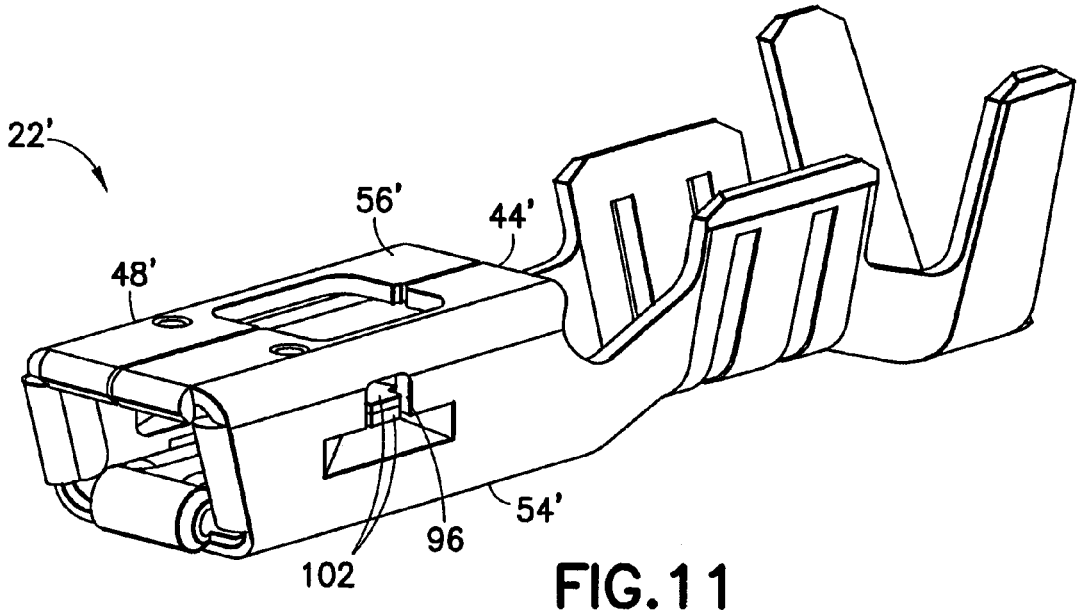
FIG. 11 is a perspective view of an alternative embodiment of one of the terminals used in the connector shown in FIG. 1.
Figure 12:
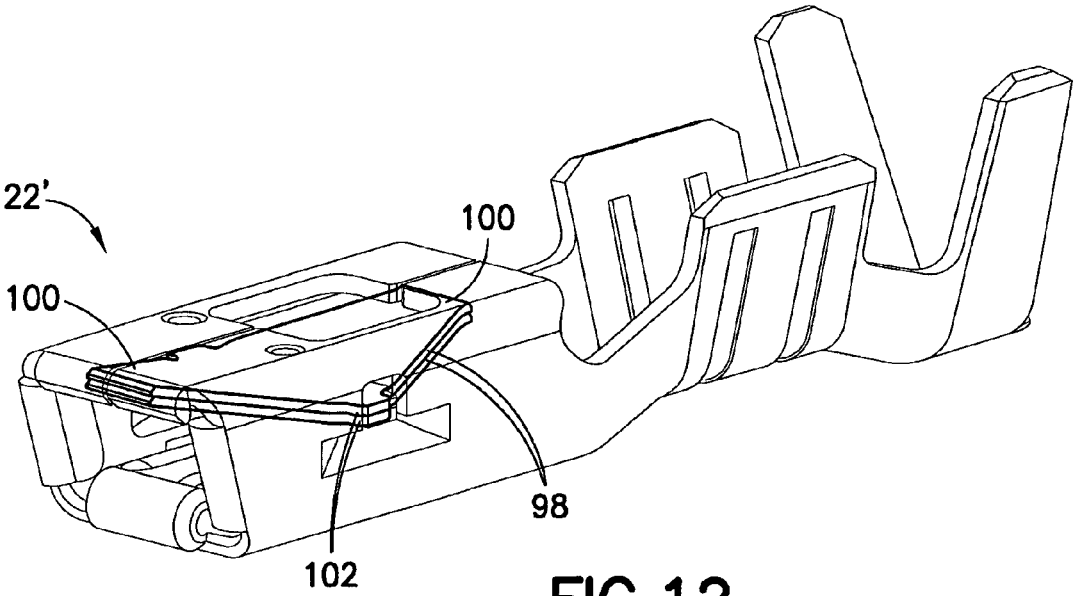
FIG. 12 is a partial cut-away perspective view of the terminal shown in FIG. 11.

It should be noted that although the previous discussion has been directed to layered springs 46 having a T-shaped end or ends captured within cantilevered projections of the frame 44 (receptacle end), other layered spring configurations are envisioned. For example, one such alternative embodiment, an electrical terminal 22' wherein the frame 44' has an elongated, or slotted, hole 96 and the springs 98 have tapered ends 100 is illustrated in FIGS. 11 and 12. In this alternative embodiment, the lateral side tabs 88 of the springs 98 each further comprise a lateral projection 102. The lateral projections 102 are movably captured within the elongated hole 96. The elongated hole 96 is configured and oriented to allow for movement in a vertical direction (direction perpendicular to a top side 56' and a bottom side 54') and prevent movement in the horizontal direction (direction parallel to the top side 56' and bottom side 54'). The elongated hole 96 is oriented such that it is perpendicular to the top side 56' and bottom side 54' of the receptacle section 48'. When the male contact 26 is inserted into the receptacle section 48', the springs 98 are substantially prevented from moving rearward (although there might be some slight movement) because of the orientation of the elongated hole 96. Thus, the center section is deflected in the vertical direction, away from the bottom side 54', as the ends 100 of the spring 98 slidably move in opposite directions (towards the front end and the rear end of the receptacle section 48') to one another along the interior of the top side 56'. This deflection allows for a contact force for mating to the male contact 26 as described above.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical terminal comprising:

a frame with a receptacle section adapted to receive a male contact;

a first spring movably captured in the receptacle section; and a second spring movably captured in the receptacle section, wherein the second spring has a first side and a second side, wherein the first side slidably contacts the first spring, and wherein the second side comprises a contact surface for contacting the male contact when the male contact is inserted into the receptacle section, wherein the first and second springs are individual separate members from the frame.

2. The electrical terminal of claim 1 wherein the first spring and the second spring are leaf springs.

3. An electrical terminal comprising:

a frame with a receptacle section adapted to receive a male contact;

a first spring movably captured in the receptacle section; and a second spring movably captured in the receptacle section, wherein the second spring has a first side and a second side, wherein the first side slidably contacts the first spring, and wherein the second side comprises a contact surface for contacting the male contact when the male contact is inserted into the receptacle section, wherein the frame further comprises holes and the first spring and the second spring each have extending lateral portions received in holes of the frame.

4. The electrical terminal of claim 1 wherein the first spring comprises a first side and a second side, and wherein the first side of the second spring slidably contacts a majority of the second side of the first spring.

5. The electrical terminal of claim 1 wherein the frame further comprises a fixed contact surface within the receptacle section.

6. The electrical terminal of claim 5 wherein the first spring and the second spring are adapted to deflect when the male contact is inserted into the receptacle section.

7. An electrical connector comprising a housing and at least one electrical terminal as in claim 1 mounted inside the housing.

8. An electrical terminal comprising:

a frame with a receptacle section adapted to receive a male contact, wherein the receptacle section comprises a fixed contact surface; and a plurality of individual separate spring, which are separate members from the frame connected to the frame, wherein the plurality of springs are disposed adjacent to one another, and wherein the springs are configured to deflect away from the fixed contact surface in response to reception of the male contact in the receptacle section.

9. The electrical terminal of claim 8 wherein the plurality of separate springs are separate leaf springs.

10. The electrical terminal of claim 9 wherein the plurality of separate springs are each in sliding contact with one another.

11. The electrical terminal of claim 10 wherein the separate springs are substantially identical to each other and have a general "V" shape.

12. The electrical terminal of claim 8 wherein each of the plurality of separate springs comprise a center section having lateral sides and wherein the frame further comprises side holes for movably capturing the lateral sides of the plurality of separate springs.

13. An electrical connector comprising a housing and at least one electrical terminal as in claim 8 mounted inside the housing.

14. An electrical terminal comprising:

a frame with a receptacle section adapted to receive a male contact, wherein the receptacle section comprises a fixed contact surface; and a leaf spring arrangement comprising at least two separate leaf spring elements disposed within the receptacle section, wherein the leaf spring arrangement is oriented opposite to the fixed contact surface, wherein the leaf spring arrangement is configured to provide a contact force on the male contact when the male contact is received between the leaf spring arrangement and the fixed contact surface, and wherein the separate leaf spring elements are substantially identical to each other, and wherein the separate leaf spring elements are stacked against one another.

15. The electrical terminal of claim 14 wherein the separate leaf spring elements are each in sliding contact with one another.

16. The electrical terminal of claim 14 wherein the leaf spring arrangement comprises means for reducing stress wherein the means for reducing stress comprises the separate leaf spring elements being slidably arranged to one another.

17. The electrical terminal of claim 1 wherein the first and second springs are substantially identical and stacked against each other.

18. The electrical terminal of claim 17 wherein a free end of the first spring is slidably located against the frame.

19. The electrical terminal of claim 18 wherein the first and second springs each have front and rear free ends located in the receptacle section of the frame.

20. The electrical terminal of claim 19 wherein middle sections of the first and second springs directly movable connect the springs to the frame.

21. The electrical terminal of claim 14 wherein the leaf spring arrangement is further configured to deflect when the male contact is received between the leaf spring arrangement and the fixed contact surface.

22. The electrical terminal of claim 14 wherein the frame further comprises a side hole movably capturing a portion of the leaf spring arrangement therein.

23. An electrical connector comprising a housing and at least one electrical terminal as in claim 14 mounted inside the housing.

24. The electrical terminal of claim 14 wherein middle sections of at least one of the springs directly movable connect the springs to the frame.

25. The electrical terminal of claim 24 wherein an opposite second free end of the first spring comprises tabs rotatably captured in pockets of the frame.

* * * * *